US009675215B2

(12) United States Patent
Corpuz, Jr. et al.

(10) Patent No.: US 9,675,215 B2
(45) Date of Patent: Jun. 13, 2017

(54) SHOWER DOOR ASSEMBLY

(71) Applicant: Kohler Co., Kohler, WI (US)

(72) Inventors: Roque M. Corpuz, Jr., Sheboygan, WI (US); James L. Marlowe, Troy, TN (US); Greg L. Parris, Medina, TN (US)

(73) Assignee: KOHLER CO., Kohler, WI (US)

( * ) Notice: Subject to any disclaimer, the term of this patent is extended or adjusted under 35 U.S.C. 154(b) by 257 days.

(21) Appl. No.: 14/528,895

(22) Filed: Oct. 30, 2014

(65) Prior Publication Data

US 2015/0113724 A1 Apr. 30, 2015

Related U.S. Application Data

(60) Provisional application No. 61/898,118, filed on Oct. 31, 2013.

(51) Int. Cl.
*A47K 3/34* (2006.01)
*A47K 3/36* (2006.01)
(Continued)

(52) U.S. Cl.
CPC ..... *A47K 3/36* (2013.01); *E05D 7/04* (2013.01); *E05D 7/12* (2013.01);
(Continued)

(58) Field of Classification Search
CPC ..... A47K 3/36; E05D 7/0027; E05D 7/0045; E05D 5/0246; E05D 2007/0469
(Continued)

(56) References Cited

U.S. PATENT DOCUMENTS 3,054,118 A * 9/1962 Bullock ..... E06B 3/50 4/607
3,978,549 A * 9/1976 Vitt ..... E05D 3/183 16/245
(Continued)

FOREIGN PATENT DOCUMENTS

CN 86101175 A 9/1987
CN 101644121 A 2/2010
(Continued)

OTHER PUBLICATIONS

European Search Report dated Mar. 18, 2015 for Application No. 14190942.4, 7 pages.
(Continued)

*Primary Examiner* — Allana Lewin Bidder
*Assistant Examiner* — Nicholas Ros
(74) *Attorney, Agent, or Firm* — Foley & Lardner LLP

(57) ABSTRACT

A shower door assembly includes a wall member, a door and a hinge assembly. The wall member is configured to be coupled to a fixed portion of a bathing enclosure. The door is pivotably coupled to the wall member by the hinge assembly, and the door is positioned such that at least a portion of the door overlaps with at least a portion of the wall member when the door is in a closed position. The door is configured to pivot about a pivot axis relative to the wall member between an opened position and a closed position. The door is also configured to translate in a direction normal to the pivot axis to selectively adjust a relative distance between a side edge of the door and a side edge of the wall member such that the door fits in a door opening of the bathing enclosure.

17 Claims, 7 Drawing Sheets

(51) Int. Cl.
*E05D 7/04* (2006.01)
*E05D 7/12* (2006.01)
*E05D 3/02* (2006.01)

(52) U.S. Cl.
CPC .. *A47K 2003/367* (2013.01); *E05D 2003/027* (2013.01); *E05D 2007/0484* (2013.01); *E05D 2007/128* (2013.01); *E05Y 2201/684* (2013.01); *E05Y 2600/12* (2013.01); *E05Y 2600/31* (2013.01); *E05Y 2900/114* (2013.01); *Y10T 16/5367* (2015.01)

(58) Field of Classification Search
USPC ..... 248/231.91, 292.14; 4/607, 610; 49/385; 16/234, 235, 249, 252–253
See application file for complete search history.

(56) References Cited

U.S. PATENT DOCUMENTS 4,606,084 A 8/1986 Baus
5,123,129 A * 6/1992 Lyons ..... A47K 3/36 16/390
5,911,519 A * 6/1999 Eutebach ..... A47K 3/362 4/607
6,253,393 B1 * 7/2001 Dries ..... A47K 3/36 16/365
6,363,547 B1 * 4/2002 Perry ..... A47K 3/30 4/612
6,618,871 B2 * 9/2003 Kopacz ..... A47K 3/36 4/605
7,614,116 B2 * 11/2009 Chen ..... E05D 7/04 16/238
2005/0251961 A1 * 11/2005 Liu ..... E05D 7/0415 16/242
2011/0024590 A1 * 2/2011 Berger ..... E05D 5/0246 248/222.14

FOREIGN PATENT DOCUMENTS

CN 102697412 A 10/2012
DE 20112236 12/2001
EP 2280142 A2 2/2011
FR 2465864 3/1981

OTHER PUBLICATIONS

DreamLine (TM) Bathroom of Your Dreams—Allure Shower Door Brochure, 2 pages.

* cited by examiner

SHOWER DOOR ASSEMBLY

CROSS-REFERENCE TO RELATED PATENT APPLICATIONS

This application claims the benefit of and priority to U.S. Provisional Application No. 61/898,118, filed on Oct. 31, 2013, the entire disclosure of which is incorporated by reference herein.

BACKGROUND

The present application relates generally to a door assembly for a bathing enclosure (e.g., a shower enclosure, etc.), and in particular to a door assembly having an adjustable hinge assembly.

Shower door assemblies typically include a fixed wall member, a door and at least one hinge assembly pivotably coupling the door to the fixed wall member. Conventional hinge assemblies have fixed mounting points on both the door and the fixed wall member. Due to this limitation, standard sized doors using conventional hinge assemblies cannot be installed in custom bathing enclosures having non-standard sized door openings. Furthermore, doors must be built to different widths to accommodate door openings of different sizes. Mass producing doors with different widths and/or modifying doors to accommodate different sized door openings can be time consuming and costly.

SUMMARY

One embodiment relates to a shower door assembly including a wall member, a door and a hinge assembly. The wall member is configured to be coupled to a fixed portion of a bathing enclosure. The door is pivotably coupled to the wall member by the hinge assembly, and is positioned such that at least a portion of the door overlaps with at least a portion of the wall member when the door is in a closed position. The door is configured to pivot about a pivot axis relative to the wall member between an opened position and a closed position. The door is also configured to translate in a direction normal to the pivot axis to selectively adjust a relative distance between a side edge of the door and a side edge of the wall member such that the door fits in a door opening of the bathing enclosure.

Another embodiment relates to a hinge assembly including a pivot member, an arm and a rail. The pivot member has a first end and a second end. The arm is pivotably coupled to the first end of the pivot member. The rail is slidably coupled to the second end of the pivot member. The rail is configured to slide relative to the pivot member to selectively adjust a translational position of the rail relative to the pivot member.

Yet another embodiment relates to a hinge assembly including a rail, an arm and a pivot member. The rail is configured to be coupled to a shower door. The arm is configured to be coupled to a stationary portion of a bathing enclosure. The pivot member has a first end pivotably coupled to the arm and a second end slidably coupled to the rail. The hinge assembly is configured to allow selective translational adjustment of a position of the shower door relative to a door opening of the bathing enclosure.

DETAILED DESCRIPTION

Referring generally to the FIGURES, disclosed herein are door assemblies for bathing enclosures (e.g., shower enclosures, showers, baths, etc.) and the like including one or more adjustable hinge assemblies. The adjustable hinge assemblies pivotably couple the door to a fixed wall member, such as a wall of a bathing enclosure (e.g., shower enclosure, etc.) or a fixed portion of a building (e.g., floor, wall, ceiling, joists, etc.). The adjustable hinge assemblies are configured to allow a user to adjust the position of the door relative to the fixed wall member such that the door can fit in door openings having different sizes (i.e., different widths). In addition, the adjustable hinge assemblies are independently adjustable to allow a user/installer to correct for out-of-plumb conditions of the door relative to a door opening/floor. In this manner, the door can be selectively adjusted to properly fit in different door opening configurations. Furthermore, the adjustable hinge assemblies eliminate the need for measuring and cutting standard sized doors to fit in custom bathing enclosures having non-standard sized door openings.

Figure 1:
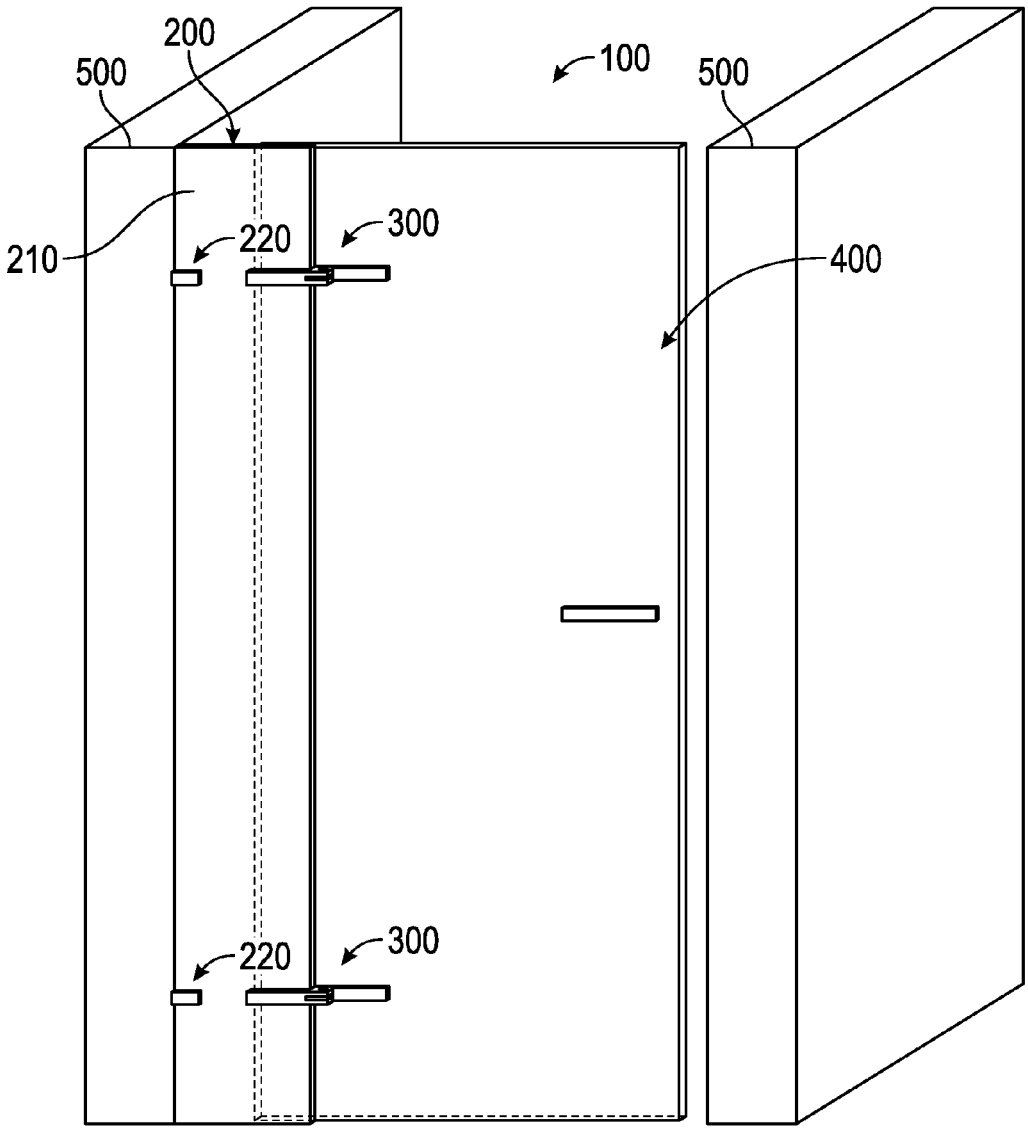
FIG. 1 is a perspective view of a shower door assembly, according to an exemplary embodiment.

Referring to FIG. 1, according to an exemplary embodiment, a shower door assembly 100 includes a wall assembly 200, a door 400, and one or more adjustable hinge assemblies 300 pivotably coupling the door 400 to the wall assembly 200. As illustrated in FIG. 1, the door 400 is substantially planar, however, according to other exemplary embodiments, the door 400 may be non-planar. The door 400 may be configured as, or include, a panel of glass, or other generally rigid material or combinations of materials. The door 400 includes a handle disposed on an outer surface of the door for a user to grasp when entering and exiting the bathing enclosure. The door 400 is configured to pivot about a generally vertical pivot axis 323*a* (shown in FIG. 3A) relative to the wall assembly 200 between an opened position and a closed position to allow for the ingress and egress of a user from the bathing enclosure during normal use (i.e., when entering or exiting the bathing enclosure). The door 400 is also configured to translate (e.g., slide, roll, move, etc.) relative to the wall assembly during, for example, installation of the door 400 to the wall assembly 200 via the adjustable hinge assemblies 300.

Figure 2:
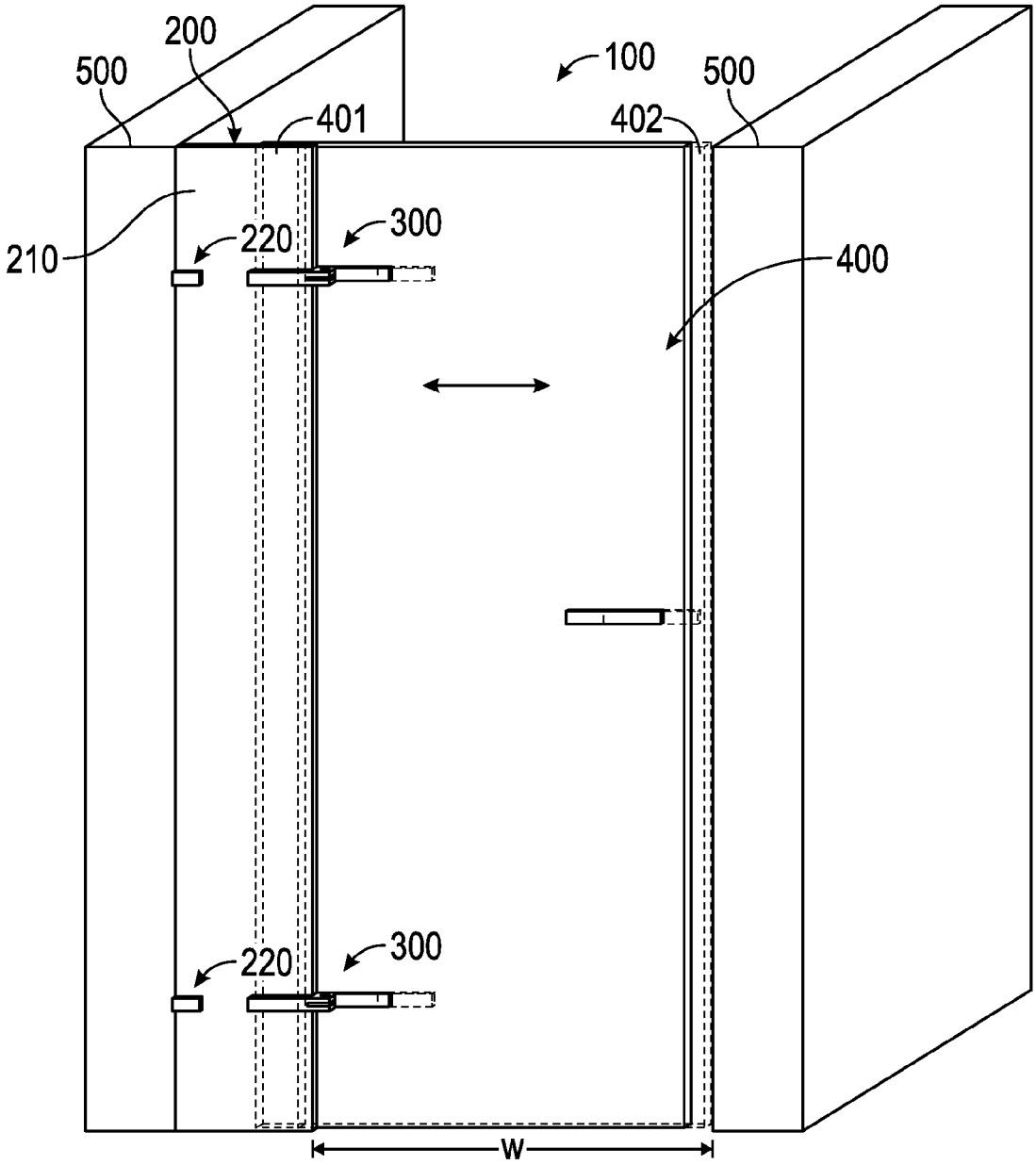
FIG. 2 is a perspective view of the shower door assembly of FIG. 1 with the door shown at two installation positions.

For example, according to an exemplary embodiment illustrated in FIG. 2, the door 400 is shown in a first position 401 relative to the wall assembly 200. Here, the wall assembly 200 is coupled to a stationary structure 500 (e.g., floor, bathing enclosure wall, ceiling, joists, etc.) such that the wall assembly is fixed relative to the stationary structure 500. In the embodiment shown, the wall assembly 200 and a portion of the stationary structure 500 collectively define a door opening having a width W for receiving the door 400.

The door opening also permits the ingress and egress of a user from the bathing enclosure.

As shown in FIG. 2, the door 400 can selectively translate (e.g., slide, roll, move, etc.) relative to the wall assembly 200 in a generally horizontal plane to a second position 402 denoted by a dashed line in FIG. 2. The door 400 can be selectively locked by an installer (or a user) at a desired position in the horizontal plane, such as position 402, relative to the wall assembly 200 such that a distance between a side edge of the door 400 and a side edge of the wall member 210 is approximately equal to the width W of the door opening. In this manner, the door 400 can be selectively adjusted to properly fit in the door opening of the bathing enclosure.

According to the exemplary embodiment of FIG. 1, the wall assembly 200 includes a wall member 210 and one or more bracket assemblies 220 coupling the wall member 210 to the stationary structure 500. According to other exemplary embodiments, the wall assembly 200 may be integrated with stationary structure 500 without the bracket assembly 220 (such as, for example, an integrated shower enclosure assembly). As shown in FIG. 1, the wall member 210 is substantially planar. According to other exemplary embodiments, the wall member 210 may be non-planar. The wall member 210 is, in one embodiment, positioned normal to an exterior surface of the stationary structure 500, such as a wall of a bathing enclosure. According to other exemplary embodiments, the wall member 210 may be positioned at an angle (e.g., an acute or obtuse angle) relative to the stationary structure 500.

Figure 3:
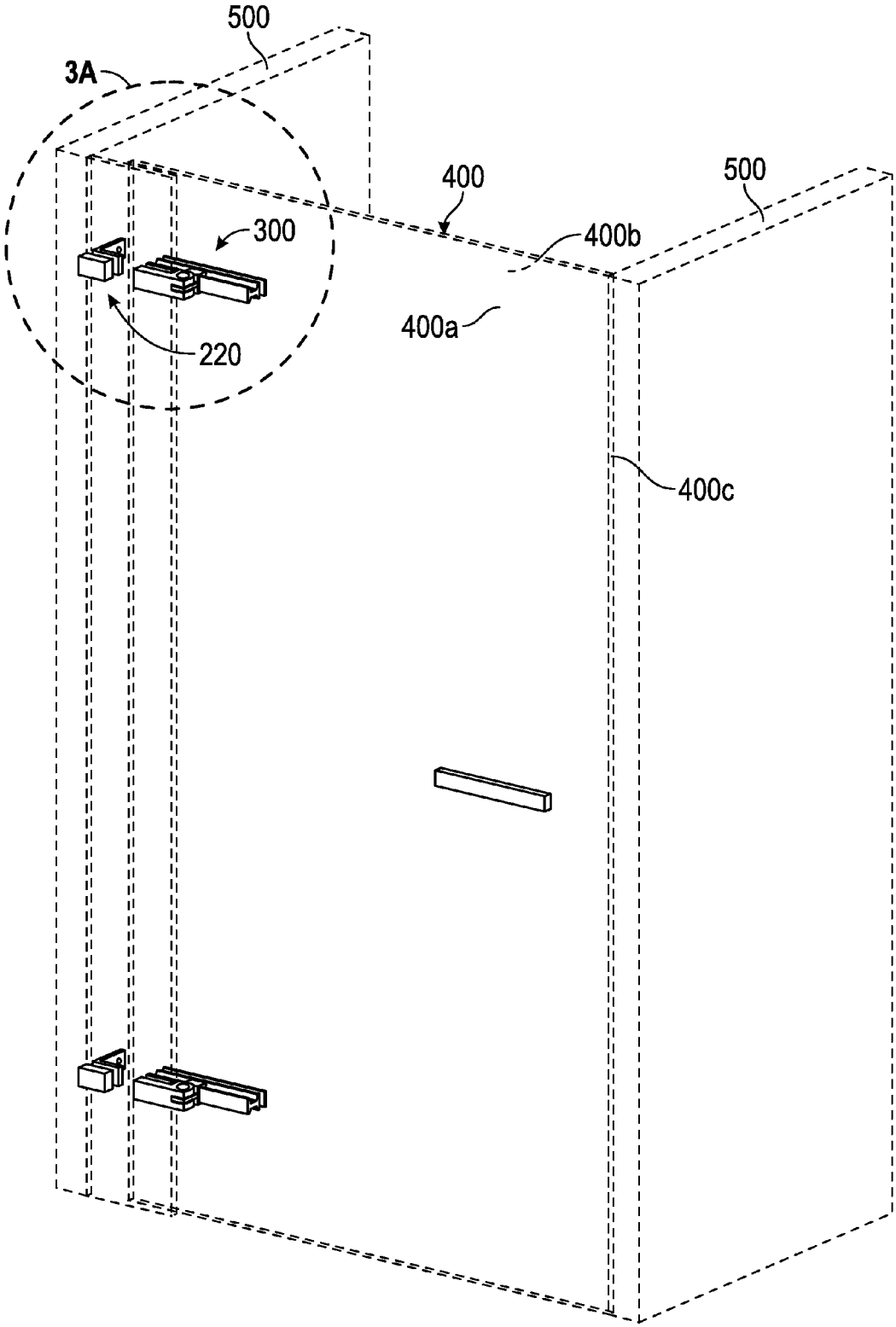
FIG. 3 is a perspective view of the shower door assembly of FIG. 1, according to an exemplary embodiment.
Figure 3A:
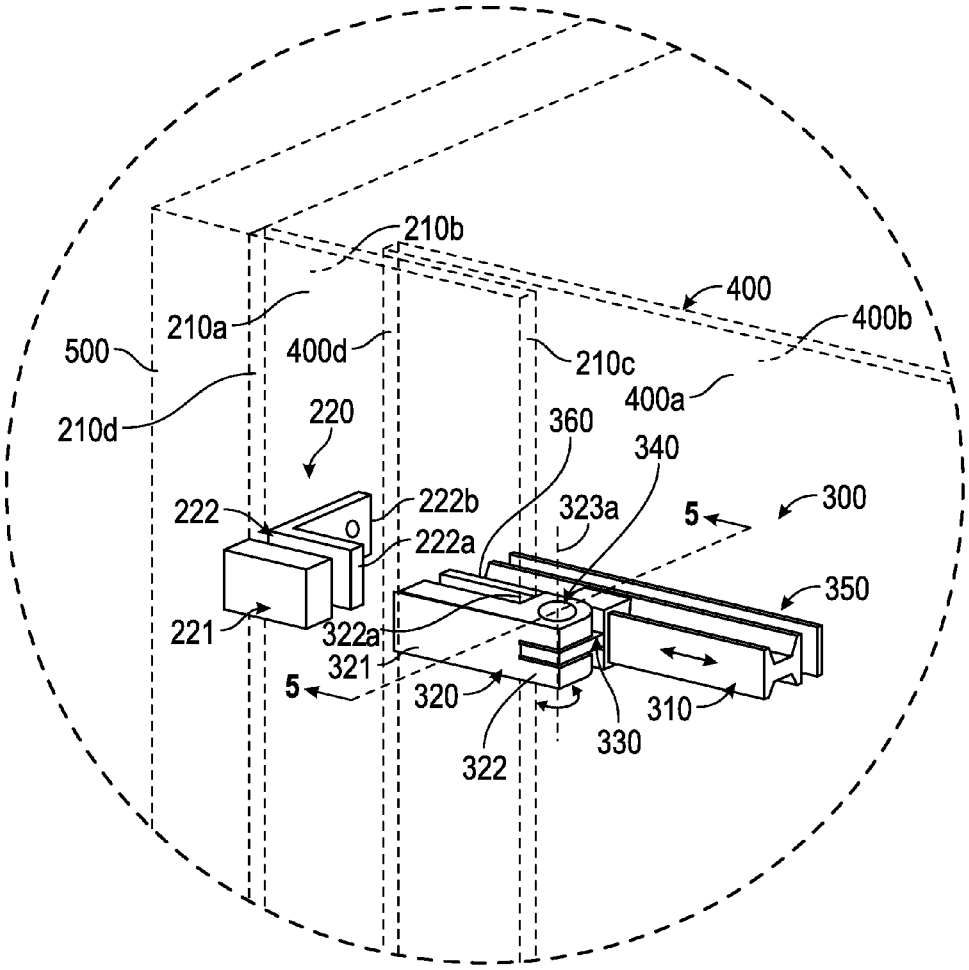
FIG. 3A is a detail view of the shower door assembly of FIG. 3, according to an exemplary embodiment.

Referring to FIGS. 3-3A, according to an exemplary embodiment, the wall member 210 has a front surface 210*a*, a rear surface 210*b*, and side edges 210*c* and 210*d*. The wall member 210 can be, for example, a panel of glass, or other generally rigid material or combinations of materials. The door 400 is shown in a closed position with at least a portion of the door 400 positioned behind the wall member 210. The door 400 is offset a distance away from the wall member 210 within the bathing enclosure when the door 400 is in the closed position (also shown in FIG. 5). According to the embodiment shown in FIGS. 3-3A, the wall member 210 forms a door opening (e.g., a space, a gap, etc.) between side edge 210*c* of the wall member 210 and a portion of the stationary structure 500 (e.g., wall, support beam, enclosure, etc.).

As shown in FIGS. 3-3A, one or more bracket assemblies 220 couple the wall member 210 to the stationary structure 500. Each of the bracket assemblies 220 includes a front member 221 and a rear member 222 coupled together with a portion of the wall member 210 disposed therebetween such that the wall member 210 is secured (e.g., mounted, fixed, coupled, etc.) between the front member 221 and the rear member 222. The rear member 222 has a first portion 222*a* positioned on the rear surface 210*b* of the wall member 210. The rear member 222 also has a second portion 222*b* that is oriented normal to the first portion 222*a* forming an "L" shape. The second portion 222*b* is coupled to the stationary structure 500 by one or more fasteners (e.g., bolts, screws, adhesive, etc.). The front member 221 is positioned on the front surface 210*a* of the wall member 210. The front member 221 is coupled to the first portion 222*a* of the rear member 222 through the wall member 210 by one or more fasteners (e.g., bolts, screws, rivets, etc.). The front member 221, the rear member 222 and the wall member 210 form a multi-layered structure with at least a portion of the wall member 210 coupled between the front member 221 and the first portion 222*a*.

According to an exemplary embodiment, the front member 221 and the rear member 222 are made from a substantially rigid material or combinations of rigid materials to provide strength to structurally support the wall assembly 200. For example, the front member 221 and/or the rear member 222 may be made from a rigid, metallic material (e.g., aluminum, steel, brass, etc.), from a plastic, a composite, or from any other suitable material that is substantially rigid.

As illustrated in the exemplary embodiment of FIGS. 1-3, two bracket assemblies 220 couple the wall assembly 200 to the stationary structure 500. According to other exemplary embodiments, more than two bracket assemblies 220 may be used to couple the wall assembly 200 to the stationary structure 500. According to an exemplary embodiment, a gasket, a seal, or other suitable element may be provided between the interface of the bracket assembly 222 and the wall member 210 to protect a surface or surfaces of the wall member 210 (e.g., a glass surface, etc.).

According to the exemplary embodiment shown in FIGS. 3-3A, the door 400 includes a front surface 400*a*, a rear surface 400*b*, and side edges 400*c* and 400*d*. In the embodiment shown, the door 400 is oriented with the side edge 400*c* facing the door opening formed between the side edge 210*c* of the wall member 210 and the stationary structure 500. The door 400 is positioned behind the wall member 210 such that the front surface 400*a* faces the rear surface 210*b* of the wall member 210.

As shown in FIGS. 3-3A, the door assembly 100 includes one or more adjustable hinge assemblies 300 pivotably coupling the door 400 to the wall member 210. The adjustable hinge assembly 300 includes an elongated member shown as rail 310, an arm 320 and a pivot member 330. The rail 310 is coupled to the front surface 400*a* of the door 400 by one or more fasteners (e.g., bolts, nuts, rivets, adhesive, etc.). The arm 320 is coupled to the front surface 210*a* of the wall member 210 by one or more fasteners (e.g., bolts, nuts, rivets, adhesive, etc.). The pivot member 330 is pivotably coupled to the arm 320 to enable the door 400 to pivot about a generally vertical pivot axis 323*a* relative to the wall member 210. The pivot member 330 is also slidably coupled to the rail 310 to enable the door 400 to move (e.g., slide, role, translate, etc.) along rail 310 in a plane normal to the pivot axis relative to wall member 210 to allow for proper positioning of the door 400 relative to the wall member 210 and the door opening.

For example, the door 400 can be selectively adjusted via the adjustable hinge assemblies 300 by selectively translating the door 400 toward or away from the pivot axis 323*a* along rail 310 in a direction normal to the pivot axis 323*a*. The door 400 can be moved such that a relative distance between the side edge 400*c* of the door 400 and the side edge 210*c* of the wall member 210 is approximately equal to the width W of the door opening of the bathing enclosure formed between side edge 210*c* and stationary structure 500. In this way, the door 400 can be selectively adjusted to fit in the door opening of the bathing enclosure.

As shown in FIG. 3A, in one embodiment, the rail 310 is coupled to a plate 350 with a portion of the door 400 coupled therebetween. The rail 310 is positioned on the front surface 400*a* of the door 400, such as, for example, near an upper end or a lower end of the door 400. The plate 350 is positioned on the rear surface 400*b* of the door 400 opposite the rail 310. The plate 350 is coupled to the rail 310 by one or more fasteners (e.g., bolts, screws, adhesive, etc.) disposed through a portion of the door 400 forming a multi-layered structure with a portion of the door 400 coupled therebetween. According to other exemplary embodiments, the rail 310 may be coupled directly to the front surface 400*a* of the door 400 using one or more fasteners (e.g., bolts, screws, adhesive, etc.). According to another exemplary embodiment, the rail 310 may be integrated into the door 400 or a portion thereof.

According to an exemplary embodiment, the rail 310 and/or the plate 350 may be made from a substantially rigid material to provide strength to structurally support the door 400. For example, the rail 310 and/or the plate 350 may be made from a rigid, metallic material (e.g., aluminum, steel, brass, etc.), a plastic, a composite, or any other suitable material that is substantially rigid. A gasket, a seal, or other suitable element may be provided between the interface of the rail 310 and the door 400, and/or the plate 350 and the door 400 to protect a surface or surfaces of the door 400 (e.g., a glass panel surface, etc.).

Figure 5:
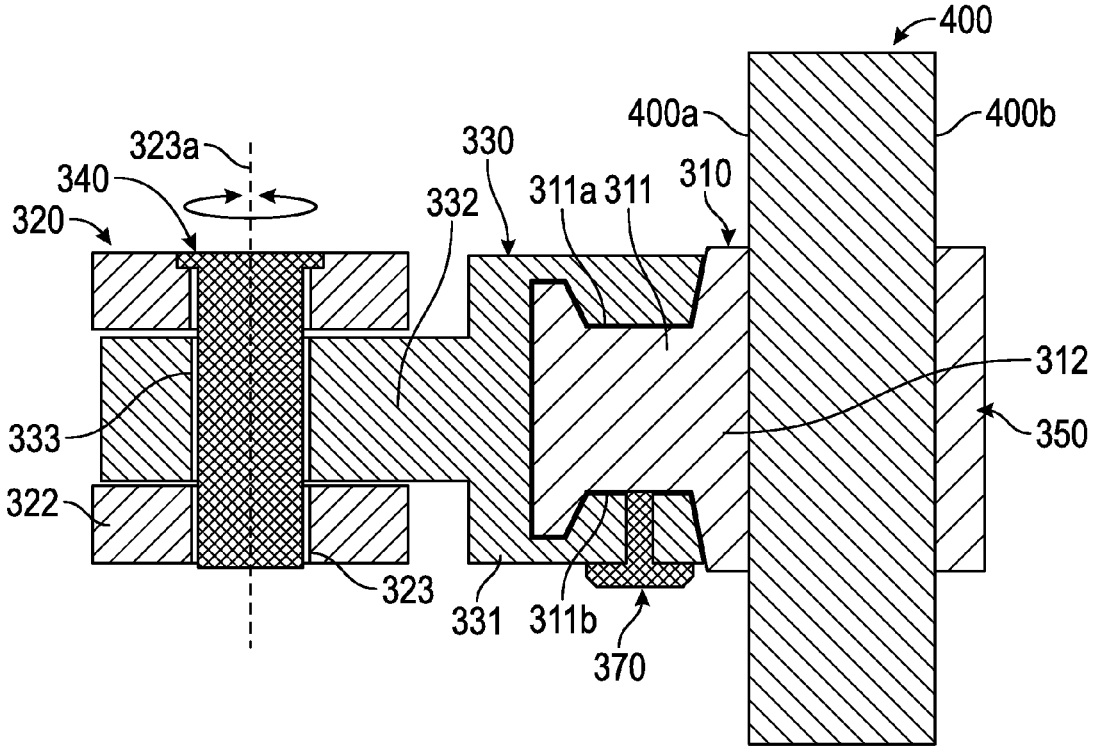
FIG. 5 is a cross-sectional view of the shower door assembly taken along line 5 in FIG. 3, according to an exemplary embodiment.

FIG. 5 is a cross-section view taken along line 5 in FIG. 3A. As shown in FIG. 5, the rail 310 has a first portion 311 and a second portion 312. The first portion 311 has a generally linear shape and extends a distance outward from the second portion 312. The first portion 311 includes an upper channel 311*a* and a lower channel 311*b*. The upper channel 311*a* and the lower channel 311*b* collectively define a surface profile configured to receive a portion of a pivot member 330. The rail 310 is configured to slide (e.g., move, translate, roll, etc.) relative to the pivot member 330 along a length of the first portion 311. According to other exemplary embodiments, the first portion 311 has a generally uniform, dovetail shape.

Figure 4:
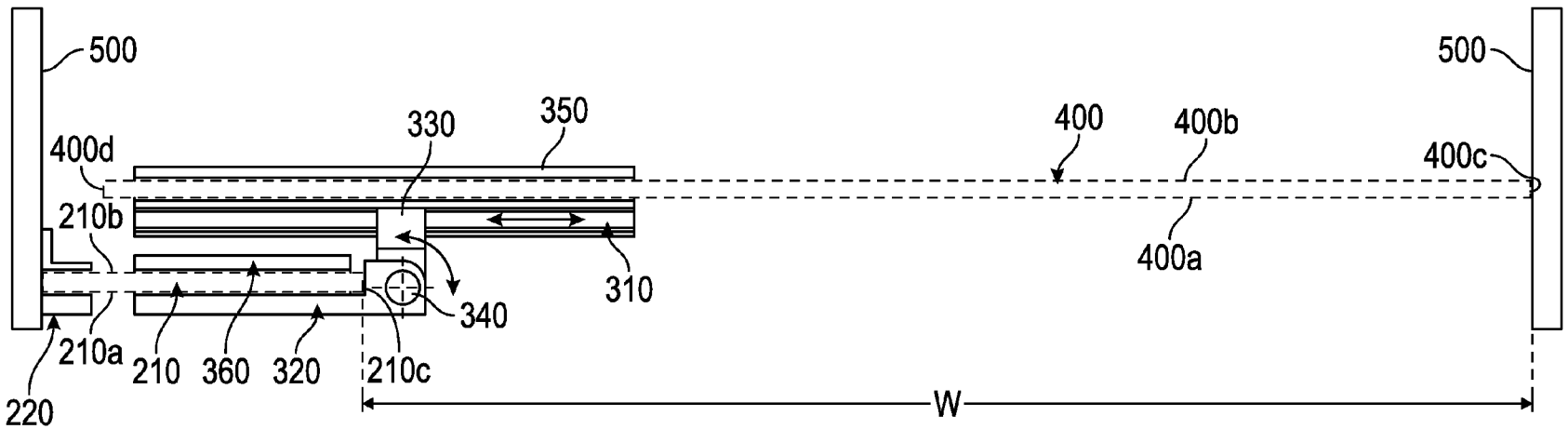
FIG. 4 is a top view of the shower door assembly of FIG. 1, according to an exemplary embodiment.

As illustrated in FIG. 3A, the arm 320 is coupled to the front surface 210*a* of the wall member 210 by a plate 360 and one or more fasteners (e.g., bolts, screws, etc.). At least a portion of the wall member 210 is disposed between the arm 320 and the plate 360 forming a multi-layered structure. According to other exemplary embodiments, the arm 320 may be coupled to the back surface 210*b* or the side edge 210*c* of the wall member 210. The arm 320 may be positioned, for example, on the front surface 210*a* near an upper end or near a lower end of the wall member 210. The arm 320 includes a fixed end 321 and a free end 322. The arm 320 is positioned on the front surface 210*a* of the wall member 210 such that the free end 322 extends outward from the side edge 210*c* of the wall member 210. The free end 322 includes a notch 322*a* abutting the side edge 210*c* such that the free end 322 overlaps with the wall member 210. As shown in FIG. 4, the free end 322 includes a horizontal slot with an opening 323 disposed therein. The hinge assembly 300 includes a pin 340 pivotably coupling a pivot member 330 to the free end 322 of the arm 320.

According to other exemplary embodiments, the arm 320 may be coupled directly to a surface or an edge of the wall member 210 (e.g., the front surface 210*a*, the back surface 210*b*, the side edge 210*c*, etc.) by one or more fasteners (e.g., bolts, screws, adhesive, etc.). According to another exemplary embodiment, the arm 320 may be integrated into the wall member 210.

As illustrated in FIGS. 3-3A, the pivot member 330 pivotably couples the door 400 to the wall assembly 200. According to the exemplary embodiment of FIG. 5, the pivot member 330 includes a slide end 331 (i.e., a first end) and a pivot end 332 (i.e., a second end). The slide end 331 is slidably coupled to the first portion 311 of the rail 310. The first portion 311 has a profile that is complementary to a profile of the slide end 331. That is, the slide end 331 has an inner profile that is substantially the same as an outer profile of the first portion 311 including upper channel 311*a* and lower channel 311*b* such that the first portion 311 is retained within the slide end 331. The interface between the slide end 331 and the first portion 311 is such that the rail 310 can move relative to the pivot member 330 along both the upper channel 311*a* and the lower channel 311*b*. In this manner, the door 400 can move (e.g., slide, roll, translate, etc.) in a generally horizontal plane along a length of the rail portion 311 during installation or adjustment of the door 400 relative to the wall assembly 200 and the door opening.

According to other exemplary embodiments, the interface between the first portion 311 of the rail 310 and the slide end 331 of the pivot member 330 may be configured such that the rail 310 can move relative to the pivot member 330, but is substantially supported by and retained within the slide end 331 of the pivot member 330. For example, according to an exemplary embodiment, the pivot end 332 includes a protrusion (e.g., a ball, etc.) extending from an upper surface of the pivot end 332. The protrusion is configured to be received within the free end 322 of the arm 320. That is, the free end 322 has a profile that is complementary to a profile of the protrusion of the pivot end 332 (i.e., the pivot end 322 has a contour that is substantially the same as the protrusion of the pivot end 332) to form a pivoting joint (e.g., a ball and socket joint, etc.). According to other exemplary embodiments, the rail 310 does not include a channel, but is configured to be received within a channel of the pivot member 330 such that the rail 310 can move relative to the pivot member 330 within the channel.

As illustrated in FIG. 3A, the pivot member 330 is pivotably coupled to the arm 320 at the pivot end 332. According to the exemplary embodiment illustrated in FIG. 5, the pivot end 332 is substantially planar and includes an opening 333 disposed therein. The pivot member 330 is positioned such that the pivot end 332 is disposed within the horizontal slot of the arm 320 with the respective openings 323 and 333 aligned. The pivot end 332 of the pivot member 330 is pivotably coupled to the free end 322 by pin 340 disposed within both of the openings 323 and 333 respectively. According to other exemplary embodiments, the pivot end 332 may be pivotably coupled to the free end 322 using a pin, bushing(s), a bolt, a rivet, or other suitable element that will allow the pivot end 332 to pivot relative to the arm 320.

According to the exemplary embodiment illustrated in FIG. 5, a lock member 370 is configured to selectively lock (e.g., set, secure, etc.) the slide end 331 to the first portion 311 at a desired position along a length of the first portion 311. Likewise, the lock member 370 is configured to selectively unlock the slide end 331 from the first portion 311 to permit relative movement between the rail 310 and the pivot member 330. In the embodiment shown in FIG. 5, the lock member 370 is positioned on a bottom surface of the slide end 331. According to other exemplary embodiments, the lock member 370 is positioned on a different surface of the slide end 331 (e.g., a top surface, a front surface, etc.). The lock member 370 is configured to contact/engage a surface of the rail portion 311 to prevent/impede movement of the rail 310 (e.g., sliding, rolling, translating, etc.) relative to the pivot member 330. In this manner, the lock member 370 can selectively set a position of the door relative to the wall assembly 200 and the door opening. According to an exemplary embodiment, the lock member 370 is a threaded set screw. According to other exemplary embodiments, the lock member 370 may be a bolt, a pin, or any other suitable element sufficient to prevent/impede relative movement between the rail 310 and the pivot member 330.

Referring to FIGS. 1-3A, according to an exemplary installation sequence, the wall member 210 is first coupled to the stationary structure 500 (e.g., floor, wall, ceiling, joists, etc.) by one or more bracket assemblies 220. In the embodiment shown, the wall member 210 is coupled to the stationary structure using two bracket assemblies 220. The wall assembly 200 (i.e., wall member 210 and bracket assemblies 220) is positioned relative to the stationary structure to form a door opening (e.g., a space, a gap, etc.) having a width W between side edge 210*c* of wall member 210 and a portion of the stationary structure 500.

One or more arms 320 are coupled to wall member 210 of the wall assembly 200. In the embodiment shown, a first arm 320 is coupled to an upper portion of the wall member 210 and a second arm 320 is coupled to a lower portion of the wall member 210. Each of the arms 320 includes a pivot member 330 pivotably coupled to a free end 322 of each of the arms 320. One or more rails 310 are coupled to the door 400. In the embodiment shown, a first rail 310 is coupled to an upper portion of the door 400 and a second rail 310 is coupled to a lower portion of the door 400. Each of the rails 310 is positioned on the door 400 to correspond to the positions of the first and second arms 320 on the wall member 210.

The door 400 is positioned in the door opening of the bathing enclosure such that a portion of the door 400 is behind the wall assembly 200 and offset a distance away from the wall assembly 200. Each of the pivot members 330 are slidably coupled to the respective rails 310 by inserting each of the rails 310 into the slide ends 332 of each of the pivot members 330. The door 400 can then be adjusted by moving (e.g., sliding, rolling, translating, etc.) the door 400 along a length of the rail 310 to a desired position relative to the wall assembly 200 and the door opening of the bathing enclosure. For example, the door 400 can be translated along rail 310 such that the distance between side edge 400*c* of the door 400 and side edge 210*c* of the wall member 210 is approximately equal to the width W of the door opening. That is, the door 400 can be translated along rail 310 in a direction normal to the pivot axis 323*a* such that the door 400 properly fits in the door opening of the bathing enclosure.

In one embodiment, the door 400 is translated to a relative position with the side edge 400*c* abutting a portion of the stationary structure 500 (e.g., a wall, a portion of a bathing enclosure, a striker plate, etc.). Once the door 400 is moved to a desired position, each of the lock members 370 on the pivot members 330 can be adjusted to engage the respective rails 310 to set the relative position of the door 400. According to an exemplary embodiment, the door 400 includes a seal extending along a length of the side edge 400*c*. The seal is configured to engage a portion of the stationary structure when the door 400 is in a closed position to prevent water from passing between the door 400 and the stationary structure 500. According to an exemplary embodiment, the door assembly 100 includes another element or member coupled to the stationary structure 500 to receive side edge 400*c* of door 400 when the door 400 is in a closed position, such as, for example, a striker plate, a seal, a frame member, or the like.

According to an exemplary embodiment, the adjustable hinge assemblies 300 are independently adjustable to allow a user/installer to adjust a relative position of the door 400 to correct for out-of-plumb conditions. For example, if the door 400 is positioned out-of-plumb (i.e., out of vertical alignment) in the door opening of the bathing enclosure, a user/installer can selectively disengage one of the lock members 370 from a rail member 310 (e.g., first or second rail members 310) and translate the door 400 to adjust the relative position of the door in the door opening. In this manner, the door 400 can be selectively adjusted to fit various door opening configurations. Moreover, the adjustable hinge assembly 300 eliminates the need for measuring and cutting standard sized doors to fit in custom built bathing enclosures having non-standard sized door openings.

Figure 6:
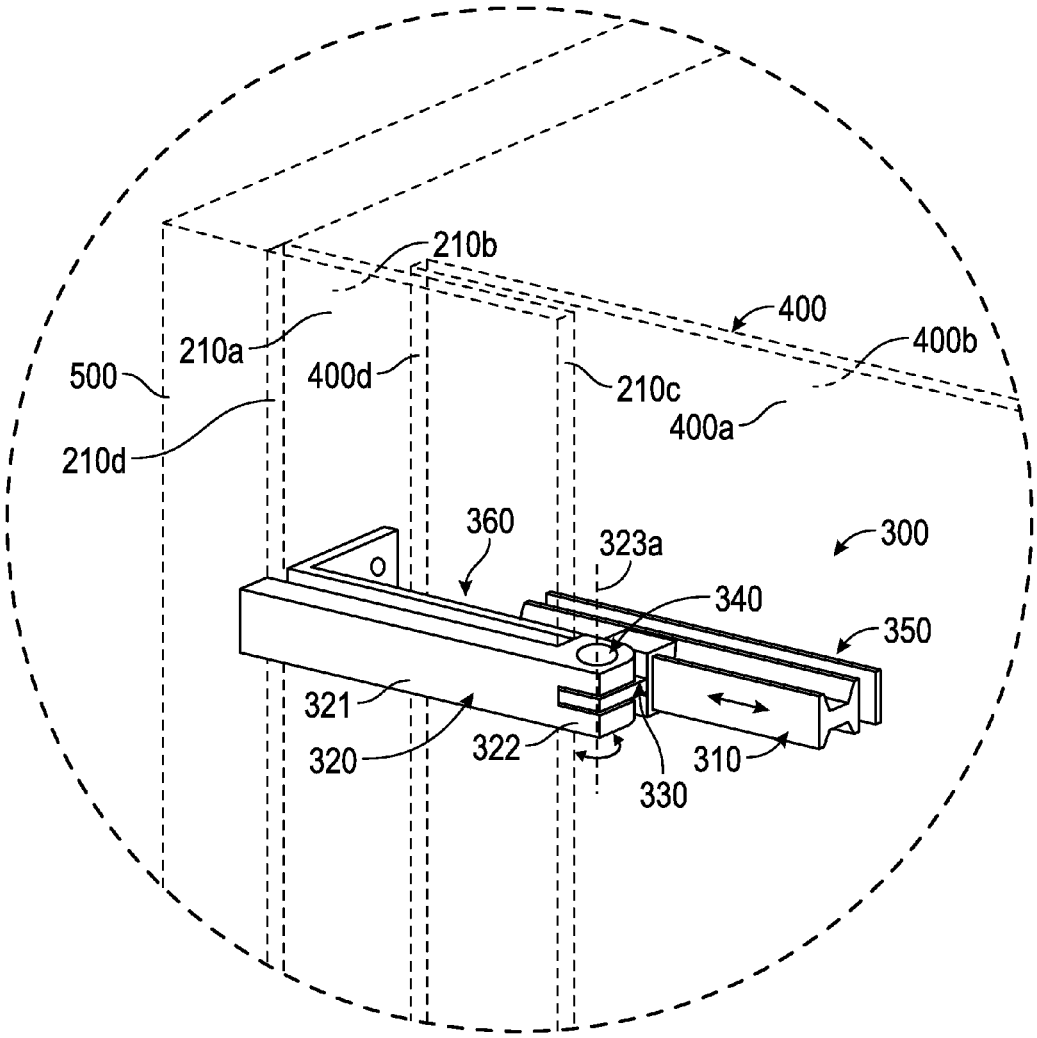
FIG. 6 is a perspective view of a shower door assembly, according to an exemplary embodiment.

Referring now to FIG. 6, the shower door assembly 100 is shown according to another exemplary embodiment. In this embodiment, the adjustable hinge assemblies 300 are configured both to couple the wall member 210 to the stationary structure 500 and to pivotably couple the door 400 relative to the wall member 210. The adjustable hinge assemblies 300 also allow selective adjustment of the door 400 relative to the wall member 210, as described above with respect to FIGS. 1-5. In this way, the adjustable hinge assemblies 300 have a dual functionality in that they are configured to fix the wall member 210 relative to the stationary structure 500 and simultaneously enable the door 400 to pivot relative to the wall member 210 between an opened position and a closed position.

As shown in FIG. 6, the arm 320 extends across a width of the wall member 210, effectively replacing the front member 221 of the bracket assembly 220 shown in FIG. 3. Similarly, the rear plate 360 coupled to the arm 320 through the wall member 210 extends across the width of the wall member 210, effectively replacing the rear member 222 of the bracket assembly 220. The rear plate 360 extends outwardly away from the wall member 210 and is configured to couple the wall member 210 to the stationary structure 500. In this manner, the adjustable hinge assemblies 300 couple the wall member 210 to the stationary structure 500 and pivotably couple the door 400 to the wall member 210.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement as illustrated for the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements illustrated as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A shower door assembly, comprising:

a wall member configured to be coupled to a fixed portion of a bathing enclosure; and a door pivotably coupled to the wall member by a hinge assembly such that at least a portion of the door overlaps with at least a portion of the wall member when the door is in a closed position, wherein the hinge assembly comprises:

a rail coupled to the door, the rail including a first portion defining an upper channel and a lower channel;

an arm coupled to the wall member;

a pivot member having a first end pivotably coupled to the arm and a second end directly, slidably coupled to the rail at the upper channel and the lower channel; and a lock member engaged with the lower channel through the second end of the pivot member;

wherein the lock member is configured to be selectively engaged with and selectively disengaged from the rail to set a translational position of the door relative to the wall member;

wherein the door is configured to pivot about a pivot axis relative to the wall member between an open position and the closed position; and wherein the door is configured to translate in a direction normal to the pivot axis to selectively adjust a relative distance between a side edge of the door and a side edge of the wall member such that the door fits in a door opening of the bathing enclosure.

2. The shower door assembly of claim 1, further comprising a bracket assembly configured to couple the wall member to the bathing enclosure;

wherein the bracket assembly includes an L shaped member and a plate;

wherein the plate is coupled to the L shaped member with at least a portion of the wall member disposed therebetween.

3. The shower door assembly of claim 1, wherein the rail is configured to slide relative to the pivot member to selectively adjust the relative distance between the side edge of the door and the side edge of the wall member when the lock member is disengaged from the rail.

4. The shower door assembly of claim 3, wherein the first portion of the rail including the upper channel and the lower channel has an outer profile that is complementary to an inner profile of the second end of the pivot member such that the first portion of the rail is retained within the second end of the pivot member.

5. The shower door assembly of claim 3, wherein the door and the wall member each include a glass panel.

6. The shower door assembly of claim 5, wherein the rail is positioned on the glass panel of the door; and wherein the arm is positioned on the glass panel of the wall member.

7. The shower door assembly of claim 3, wherein the hinge assembly is a first hinge assembly, and the shower door assembly further comprises a second hinge assembly pivotably coupling the door to the wall member; wherein the first and second hinge assemblies are each independently adjustable such that the door can be selectively adjusted to correct for an out-of-plumb condition of the door relative to the door opening.

8. The shower door assembly of claim 3, wherein the arm includes a portion that extends outwardly from the side edge of the wall member; and wherein the portion of the arm includes a notch abutting the side edge of the wall member.

9. The shower door assembly of claim 3, wherein the arm is coupled to the wall member by a plate positioned opposite the arm on the wall member; wherein the arm, a portion of the wall member, and the plate form a multi-layered structure with the portion of the wall member coupled between the arm and the plate.

10. The shower door assembly of claim 9, wherein the arm and the plate are configured to couple the wall member to the bathing enclosure.

11. A hinge assembly, comprising:

a pivot member having a first end and a second end;

an arm configured to be coupled to a wall member, the arm pivotably coupled to the first end of the pivot member;

a rail configured to be coupled to a door, the rail directly, slidably coupled to the second end of the pivot member at an upper channel and a lower channel of the rail; and a lock member engaged with the lower channel of the rail through the second end of the pivot member;

wherein the rail is configured to slide relative to the pivot member to selectively adjust a translational position of the rail relative to the pivot member; and wherein the lock member is configured to be selectively engaged with and selectively disengaged from the rail to set the translational position of the rail relative to the pivot member.

12. The hinge assembly of claim 11, wherein the pivot member is configured to pivot relative to the arm about a vertical pivot axis; and wherein the rail is configured to slide relative to the pivot member in a direction normal to the pivot axis.

13. The hinge assembly of claim 11, wherein the second end of the pivot member includes a channel configured to receive at least a portion of the rail.

14. The hinge assembly of claim 11, wherein the arm includes a slot configured to receive the first end of the pivot member.

15. The hinge assembly of claim 11, further comprising a pin pivotably coupling the first end of the pivot member to the arm.

16. A hinge assembly, comprising:

a rail configured to be coupled to a shower door, the rail including a first portion defining an upper channel and a lower channel;

an arm configured to be coupled to a stationary portion of a bathing enclosure;

a pivot member having a first end pivotably coupled to the arm and a second end directly, slidably coupled to the rail at the upper channel and the lower channel; and a lock member engaged with the lower channel of the rail through the second end of the pivot member;

wherein the hinge assembly is configured to allow selective adjustment of a position of the shower door relative to a door opening of the bathing enclosure; and wherein the lock member is configured to be selectively engaged with and selectively disengaged from the rail to set the position of the shower door relative to the door opening.

17. The hinge assembly of claim 16, wherein the pivot member is configured to pivot relative to the arm about a vertical pivot axis; and wherein the rail is configured to slide relative to the pivot member in a direction normal to the pivot axis to allow selective translational adjustment of the shower door position.

* * * * *